US006957546B1

(12) United States Patent
Farley et al.

(10) Patent No.: US 6,957,546 B1
(45) Date of Patent: Oct. 25, 2005

(54) PORTABLE ICE SKATING RINK

(75) Inventors: Pierre Farley, Laval (CA); Nicolas Farley, St-Lambert (CA)

(73) Assignee: Farley Ice Technologies Inc., Montreal (CA)

( * ) Notice: Subject to any disclaimer, the term of this patent is extended or adjusted under 35 U.S.C. 154(b) by 0 days.

(21) Appl. No.: 08/811,925

(22) Filed: Mar. 5, 1997

(51) Int. Cl.[7] ..... A63C 19/10
(52) U.S. Cl. ..... 62/235; 472/90
(58) Field of Search ..... 62/235; 472/90; 473/466

(56) References Cited

U.S. PATENT DOCUMENTS 2,907,362 A * 10/1959 Owen ..... 62/235
2,996,896 A * 8/1961 Johnson ..... 62/235
3,797,049 A * 3/1974 De Santo ..... 62/235
3,933,002 A * 1/1976 Vickery ..... 62/235
5,134,857 A * 8/1992 Burley ..... 62/235
5,669,227 A * 9/1997 Morris ..... 62/235

FOREIGN PATENT DOCUMENTS

DE 2403961 * 7/1975 ..... 62/235

* cited by examiner

*Primary Examiner*—Mark S. Graham
(74) *Attorney, Agent, or Firm*—Ogilvy Renault

(57) ABSTRACT

A portable ice skating rink comprises, in a kit, a plastic sheeting, a protective band for the sheeting, and a number of rigid tubular members, flexible connectors and corrugated clips. To assemble the kit, the tubular members are connected to each other in a closed loop using the flexible connectors inserted in facing ends thereof and with corners of the loop being formed by curving some flexible connectors. The sheeting is then laid over the ground of the area enclosed by the loop while extending outwardly over and past the loop. The protective band is laid over the sheeting opposite the loop and the clips are installed thereat to secure the sheeting to the so formed frame with the clips running continuously all along the frame such as to protect the sheeting. Portions of the frame can be raised to level it and the sheeting can then be pulled.

6 Claims, 3 Drawing Sheets

PORTABLE ICE SKATING RINK

BACKGROUND OF THE INVENTION

1. Field of the Invention

The present invention relates to skating rinks and, more particularly, to portable ice skating rink.

2. Description of the Prior Art

Ice skating is a popular activity but requires that one wishing to skate on ice or play a friendly game of ice hockey go a to the local city indoor arena or outdoor winter rinks and these facilities are not always available, being subject to organized hockey schedules, and the like. Also, such public ice skating rinks are often very populated or busy, aside from being located remotely from one's home.

Accordingly, portable ice skating rinks have become popular and one can always resort to old fashioned frozen ponds or to artificially flooded sheets of ice on private yards. Such artificial home ice rinks require a tremendous amount of water, and thus time, as water is initially absorbed by the lawn until it has become saturated. If, after the ice skating surface has been constructed, it is subjected to higher temperatures, the ice may melt and be at least partly, if not completely, absorbed by the lawn thereby requiring a complete reconstruction of the ice rink. Finally, frozen water laid directly on grass results in damage to the grass' roots which thereafter causes yellow grass in the spring which even carries into summer. Ice rinks constructed directly onto lawns are also difficult to level as the ice will follow the geometric configuration of the lawn surface.

As an improvement over these natural or artificial outdoors ice skating rinks, U.S. Pat. No. 5,134,857 issued to Burley on Aug. 4, 1992 discloses a portable ice rink comprising a plastic sheeting having its edges overlapping a peripheral barrier adapted to hold the sheet in place on the ground and to provide a barrier for the formation of ice on the plastic sheeting. The peripheral barrier is made of a number of elongated sectional flexible closed cell rods fitted into straight tubular rigid fittings such as to define the sides of the rink, whereas corner tubular rigid fittings being provided for assembling the sides of the rink into a closed loop with the ends of the flexible rods of each side being fitted in respective corner fittings. Once this peripheral frame or barrier has been assembled, the plastic sheeting is laid such as to cover the entire inner area defined thereby and also to overlap the barrier. The plastic sheeting is draped over the barrier and resilient C-shaped liner retaining clips are applied over the plastic sheeting and barrier in a spaced apart distributed fashion all along the peripheral barrier thereby attaching the sheeting to the barrier. The barrier is particularly useful in preventing, to some extent, water overspills.

SUMMARY OF THE INVENTION

It is therefore an aim of the present invention to provide an improved portable ice skating rink.

It is also an aim of the present invention to provide a portable ice skating rink comprised of a plastic sheeting and a frame connected peripherally thereto, wherein, once an ice surface has formed on the plastic sheeting and within the peripheral frame, the frame itself protects the plastic sheeting against cuts where the ice surface outwardly ends.

It is a further aim of the present invention to provide a portable ice skating rink in which the frame comprises a series of rigid tubular members connected to each other by short foam-like solid cylindrical connectors with the corners of the frame being ensured by such cylindrical connectors as they can be bent substantially as desired, whereby the same connectors can be used to form corners of varying angles.

It is a still further aim of the present invention to provide a portable ice skating rink in which the frame further comprises slit corrugated tubes which are adapted to be positioned over the frame and continuously therealong with the plastic sheeting being imprisoned therebetween thereby assembling the sheeting to the frame.

It is a still further aim of the present invention to provide a portable ice skating rink in which the frame further comprises plastic bands extending between the corrugated tubes and the plastic sheeting to protect the sheeting from edges of the corrugated tubes and to allow for the sheeting to be slidably displaced relative to the frame.

It is a still further aim of the present invention to provide a portable ice skating rink in which colored plastic bands are used to provide the rink with hockey-type lines.

It is a still further aim of the present invention to provide a method of installation for a portable ice skating rink.

Therefore in accordance with the present invention, there is provided a portable ice rink comprising sheet means, a plurality of frame members and of first and second connector means, said first connector means being adapted to connect said frame members successively in an end-to-end relationship such as to form a closed frame means for said rink, said sheet means being adapted to be laid across said frame means and to be connected thereto by way of said second connector means, said second connector means being provided substantially continuously along said frame means, whereby water deposited onto said sheet means inwardly of said frame means and then having frozen thereon forms an ice sheet, wherein said second connector means and said ice sheet completely cover said sheet means at upper and side portions of said frame means.

Also in accordance with the present invention, there is provided a portable ice rink comprising sheet means, a plurality of tubular frame members and of first, second and third connector means, said first connector means being adapted to connect said frame members successively in an end-to-end relationship such as to form straight sides of a closed frame means for said rink, said second connector means being adapted to connect said straight sides together while providing corners to said frame means, said sheet means being adapted to be laid across said frame means and to be connected thereto by way of said third connector means, whereby water deposited onto said sheet means inwardly of said frame means and then having frozen thereon forms an ice sheet, wherein said second connector means comprise flexible elongated elements which are curved to form said corners.

Further in accordance with the present invention, there is provided a portable ice rink comprising frame means, sheet means and at least one colored elongated band means, said sheet means being adapted to be laid across said frame means and to be connected thereto by way of connector means, whereby water deposited onto said sheet means inwardly of said frame means and then having frozen thereon forms an ice sheet, wherein said ice sheet comprises at least upper and lower layers and said band means extends across said ice sheet intermediate said upper and lower means thereby providing said rink with hockey-type lines.

Still further in accordance with the present invention, there is provided a method of installing a portable ice rink on a surface, comprising the steps of:

a) laying frame means on a support surface;

b) laying sheet means across and onto said frame means;

c) securing with connector means said sheet means to said frame means and continuously along said frame means; and d) depositing water on said sheet means and within said frame means, leveling said frame means, and allowing the water to freeze thereby forming an ice sheet;

wherein said connector means and said ice sheet cooperate to conceal said sheet means at least inwardly from an upper portion of said frame means such as to protect said sheet means.

BRIEF DESCRIPTION OF THE DRAWINGS

Having thus generally described the nature of the invention, reference will now be made to the accompanying drawings, showing by way of illustration a preferred embodiment thereof, and in which.

DESCRIPTION OF THE PREFERRED EMBODIMENTS

Figure 1:
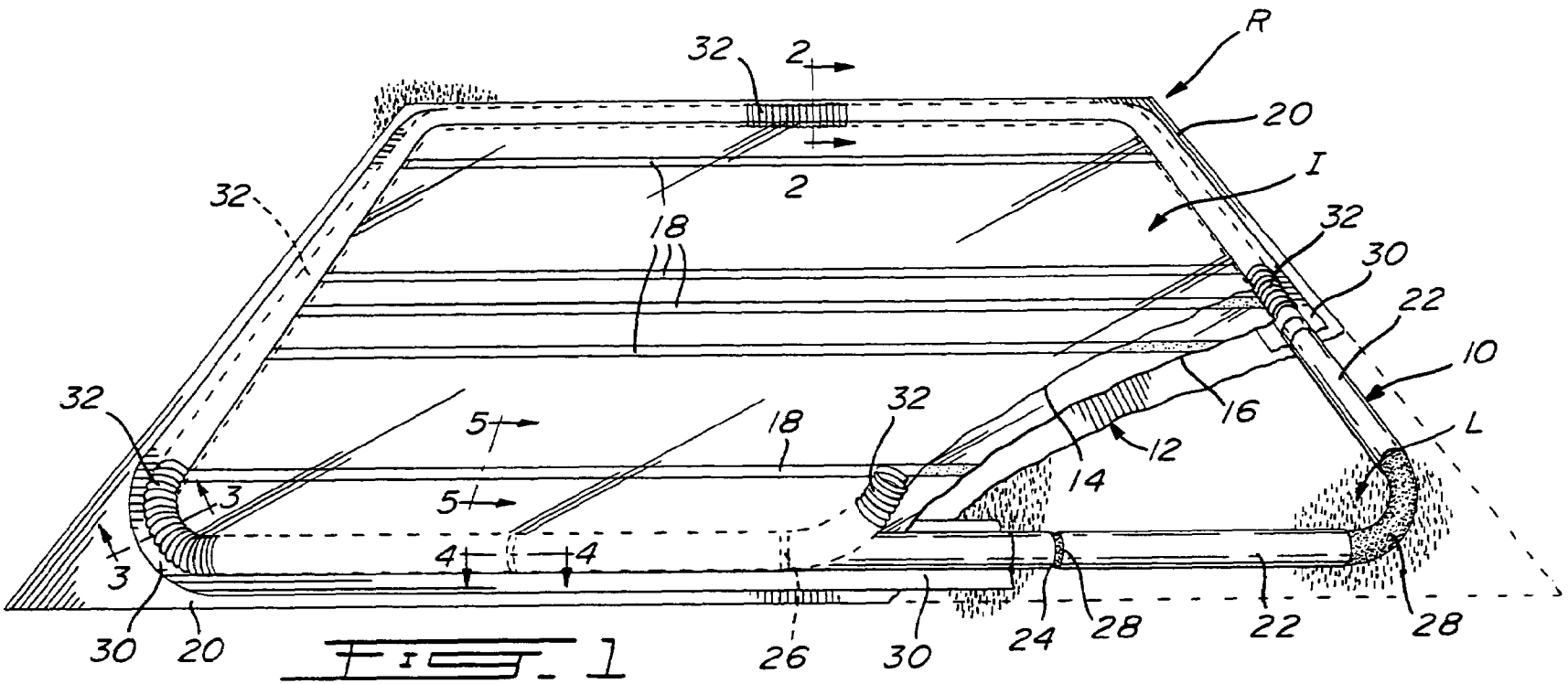
FIG. 1 is a fragmented perspective view of a portable ice skating rink in accordance with the present invention.

FIG. 1 illustrates in a fragmented perspective view a portable ice skating rink R in accordance with the present invention which is shown in position on a lawn L (or the like) and which comprises a frame assembly 10 and a plastic sheeting 12 extending across the frame assembly 10 and connected thereto, as detailed hereinafter.

Figure 5:
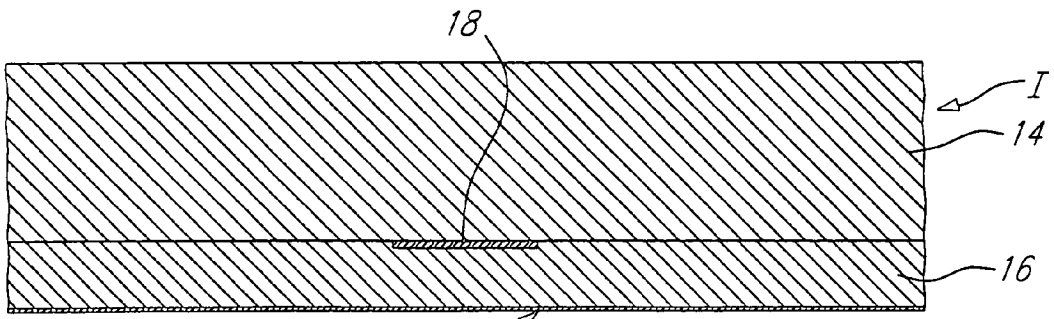
FIG. 5 is a vertical cross-sectional view taken along line 5—5 of FIG. 1 and showing a hockey-type line running across the ice of the rink, intermediate two layers thereof.

The sheeting 12 which is made of an impermeable flexible plastics material is adapted to receive water thereon which, once frozen, will form an ice sheet I. In the illustrated skating rink R, the ice sheet I consists of an upper and a lower layer of ice 14 and 16, respectively, such that elongated bands 18 can be laid across the ice sheet I between the upper and lower layers 14 and 16 such to provide the rink R with hockey-type lines. Indeed, as best seen in FIG. 5, water is first deposited onto the plastic sheeting 12 thereby forming, once frozen, the lower ice layer 16. Then, the bands 18 which are made of flexible colored polyethylene are moistened in hot water and then laid across and onto the lower ice layer 16 which slightly causes the lower layer 16 to melt thereby positioning the bands 18. Thereafter, fresh water is deposited on the lower ice layer 16 and on the bands 18 such that when this added water freezes, it forms the upper ice layer 14.

As best seen in FIG. 1, the plastic sheeting 12 is dimensioned such that, when laid across the lawn, or the like, it extends over the frame assembly 10 and outwardly past the frame assembly 10 thereby forming a peripheral take-up strip 20 of a use which will be described hereinbelow.

Figure 4:
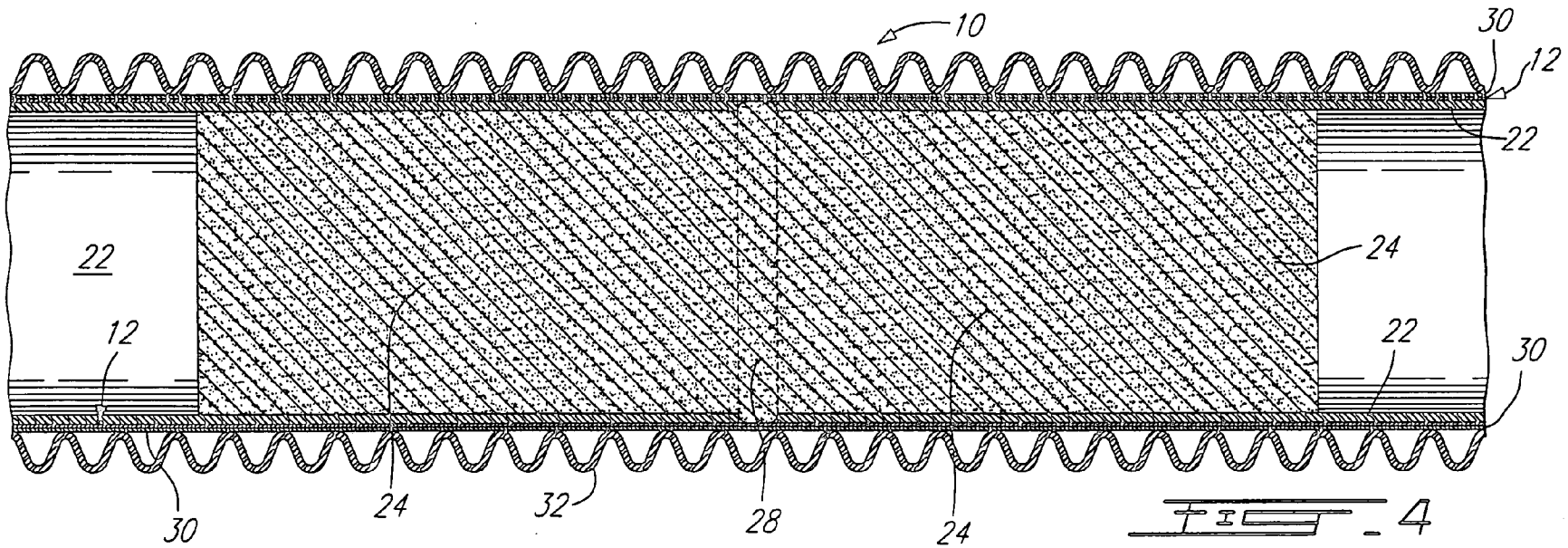
FIG. 4 is a horizontal longitudinal sectional view taken along line 4—4 of FIG. 1 and further showing the assembly of the plastic sheeting to the frame.

The frame assembly 10 comprises a series of rigid PVC tubular members 22, e.g. pipes of annular cross-section, which are disposed in longitudinal alignment with each other for each side of the frame assembly and, more particularly, for the four sides thereof in the case of rectangular or square rinks R. The tubular members 22 are connected to each other with flexible closed cell foam connectors 24 (i.e. polyethylene) in the form of cylindrical rods which are resiliently inserted in facing ends of each pair of successive tubular members 22. As seen in FIGS. 1 and 4, a gap 26 may be retained between adjacent tubular elements 22.

At the corners of the frame assembly 10, longer flexible closed cell foam connectors 28 may be used with ends thereof being inserted in free ends of each pair of successive sides of the frame assembly 10, as best seen in FIG. 1. Indeed, the corner connectors are flexible enough to be bent into shape and connect together end tubular members 22 while defining the corners of the frame assembly 10. It is noted that, when the water will freeze on the plastic sheeting 12, any expansion horizontal of the water will be accommodated within the frame assembly 10 by the tubular members slidably displacing away from their respective side connectors 24 (and perhaps also from the end connectors 28) thereby becoming slightly more distant from one another and increasing the gaps 26; the flexible foam connectors 24 and 28 are obviously of a length such that they are sufficiently inserted in the tubular members 22 to still retain the latter connected together by theses flexible connectors 24 and 28 even the frame assembly 10 has increased in span due to the expansion of the water during its freezing.

Once the tubular members have been connected in a closed loop by way of the side foam connectors 24 and the end foam connectors 28, the plastic sheeting 12 is deposited thereon. Then, a peripheral protective band 30 (e.g. ten inch wide) made of a number of successive plastic strips is laid longitudinally along the sides of the frame assembly 10 and, more particularly, onto the tubular members 22 and the foam connectors 24 and 28. Longitudinally slit flexible corrugated clips 32 (of about 1½ inch diameter) are subsequently used to secure the plastic sheeting 12, the plastic peripheral protective band 30 and the tubular members 22 together. The corrugated clips 32 basically correspond to sections of flexible polyethylene tubing which are each slit or cut along their entire length, parallelly to their central axes, and which can be forcibly opened into C-shaped cross-sections such that they can be resiliently slipped, with their slits facing down and gradually from one end to another, over the plastic sheeting 12, the protective band 30 and the tubular members 22, as seen at the bottom of FIG. 1 thereby securing these components together.

Figure 2:
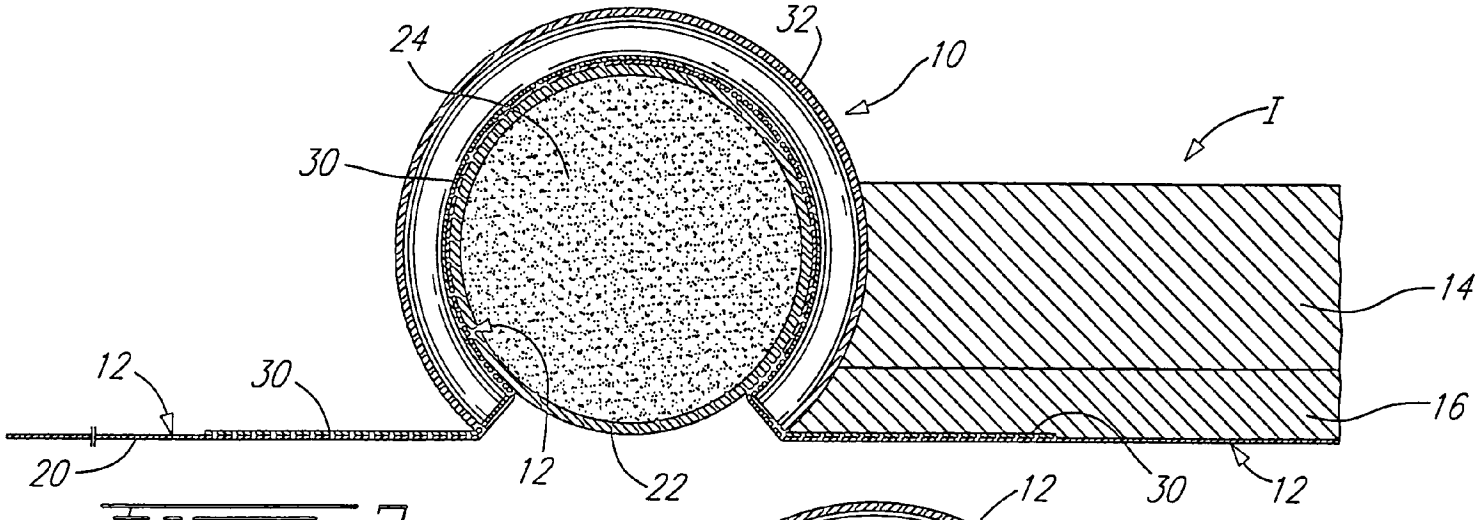
FIG. 2 is a vertical cross-sectional view taken along line 2—2 of FIG. 1 and showing the assembly of a plastic sheeting of the rink to a frame thereof.
Figure 3:
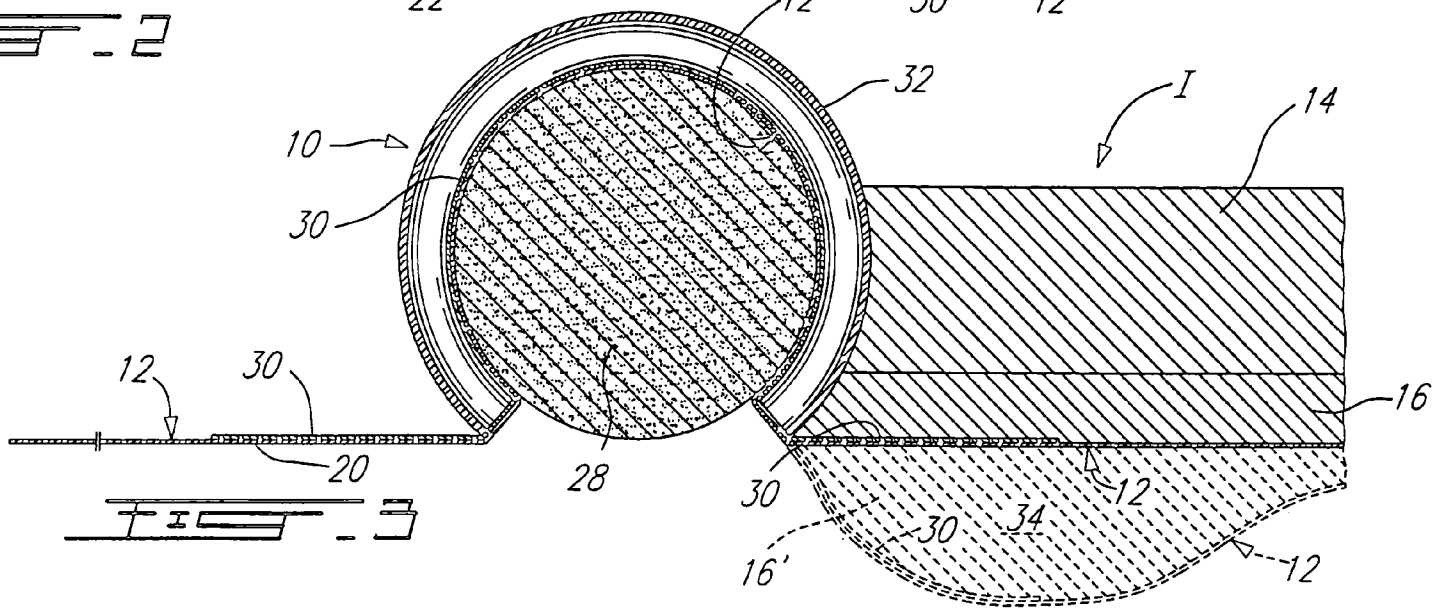
FIG. 3 is a vertical cross-sectional view taken along line 3—3 of FIG. 1 and showing the assembly of the plastic sheeting to a corner of the frame and also showing, in phantom lines, the position of the plastic sheeting adjacent an elevated frame portion.

Such corrugated clips 32 are installed continuously along the entire frame assembly 10 such that, once the ice sheet I has been formed on the plastic sheeting 12 and within the frame assembly 10, the ice sheet S and the corrugated clips 32 completely cover and thus conceal the plastic sheeting 12 at the frame assembly 10 and inwardly thereof, as seen in FIGS. 2 and 3, whereby the plastic sheeting 12 is protected from cuts which can be caused by skates during skating close to the frame assembly 10 or embarking on or disembarking from the ice I or which can be caused by shovels during snow clearing operations of the ice I after a snowfall or after prolonged skating. The continuous corrugated clips 32 also ensure a very secure assembly of the plastic sheeting 12 to the frame assembly 10.

The protective band 30, being located intermediate the corrugated clips 32 and the plastic sheeting 12, prevents the longitudinal edges of each corrugated clip 32 which are formed by the slit defined therealong from digging into and perforating the plastic sheeting 12 which could allow, at least on the inner side of the frame assembly 10, for water leakage prior to formation of the ice I or after the latter has melted due to mild weather.

Once the corrugated clips 32 have been installed continuously along the frame assembly 10, the rink R is ready to receive water, whereby water is supplied onto the plastic sheeting 12, i.e. on the area thereof defined within the frame assembly 10. If there is a greater accumulation of water at a corner of the rink R, this corner of the frame assembly 10 is lower than the rest of the frame structure and allowing the water to freeze under these conditions might result in the skating rink R having a very thin sheet of ice I, if any, at other locations of the plastic sheeting 12 and a skate could go though the ice I and the plastic sheeting 12 thereat.

Therefore, it is preferable to raise such a lower corner and this can be easily achieved by frame assembly 10 at this corner and by packing snow thereunder to elevate the corner substantially at a same level as the remainder of the frame assembly 10. This adjustment is made possible by the overall rigid structure of the frame assembly 10 which allows for one of its corners and adjacent tubular members 22 to be manually raised.

Furthermore, in order that the plastic sheeting 12 located just inwardly of the elevated corner is not without support from the ground located thereunder, or in other words so that it is not suspended, the plastic sheeting 12 can be manually pulled on inwardly from the corner and adjacent sides of the frame assembly 10 such that it slides between a respective corner foam connector 28 (and possibly adjacent tubular members 22) and the peripheral band 30 located under its covering corrugated clip 32. The plastic sheeting 12 is pulled sufficiently so that it lies, at least mostly, on the ground thereby forming a pocket 34 whereat the lower ice layer 16' will simply be thicker, as seen in phantom lines in FIG. 3. Obviously, one can pull outwardly on the frame assembly 10 at the low corner thereof instead of pulling inwardly on the plastic sheeting 12. It is noted that the plastic sheeting 12 may be pulled from any of the sides and corners of the frame assembly 10, as required if, for instance, various portions of the frame assembly 10 must be raised to level the rink R.

It is noted that the take-up strip 20 provides the additional material which allows for the plastic sheeting 12 to form the pocket 34. Also, the plastic peripheral band 30 facilitates the sliding of the plastic sheeting 12, when it is being pulled, as, without the peripheral band 30, the plastic sheeting 12 would slide between the corrugated clips 32 and the corner foam connector 28 and adjacent tubular members 22, and the corrugated clips would offer more resistance to the sliding displacement of the plastic sheeting 12 than the peripheral band 30.

After installation, the take-up strip 20 can be protected by folding it downwardly and inwardly under the frame assembly 10 and the plastic sheeting 12, whereby only the sheet of ice I and the corrugated clips 32 are visible.

The frame assembly 10, once installed, acts as a water barrier which is at least 2¼ inches high. The combination of rigid tubular members 22 and flexible connectors 28 can allow for a variety of frame configurations.

When the above kit is packaged at the manufacture, the corrugated clips 32 are mechanically installed over the tubular members 22 for compact packaging purposes and also to spread the corrugated clips 32 at their slits for facilitating the installation thereof over the plastic sheeting 12, the peripheral band 30 and the tubular members 22 by the home owner.

As opposed to Burley's U.S. Pat. No. 5,134,857 described hereinabove, the portions of the plastic sheeting 12 of the present invention which are not covered by ice are shielded against damage, for instance from cuts resulting from contact with the skates' blades or with shovels in snow clearing operations, by the corrugated protecting sleeves or clips 32 which run continuously along the frame assembly 10, whereby the plastic sheeting 12 is not exposed.

Moreover, in Burley, the frame of the ice skating rink is flexible in view of its structure being mostly ensured by the sectional foam rods, whereby it cannot be lifted for adjusting its position relative to the ground with a view to rendering the frame or barrier as horizontal as possible. In the present invention, the rigid PVC tubular members 22 which extend along substantially all of the periphery produce a sufficiently rigid frame which can be manually lifted, for instance at one or more corners thereof, to level the frame and provide a substantially horizontal peripheral barrier to the ice skating rink R. The take-up strip 20 of the present invention allows for the plastic sheeting 12 to be pulled inwardly for allowing it to follow the ground when a corner of the frame assembly 10 is so elevated.

In the present invention, expansion of the frame assembly 10 without disassembly or disengagement of components thereof is ensured by the foam connectors 24 and 28 which are inserted in the tubular members 22 to join them and with respect to which the tubular members 22 can displace and accommodate the increasing volume of water as it freezes. Short connection fittings may not be able to compensate for frame expansion as can the foam connectors 24 and 28 of the present skating rink R.

We claim:

1. A portable ice rink comprising sheet means, a plurality of frame members adapted to be connected in an end-to-end relationship such as to form a closed frame for said rink, said sheet means being adapted to be laid across said frame and to be connected thereto by way of secondary connectors, said secondary connectors being provided substantially continuously along said frame, whereby water deposited onto said sheet means inwardly of said frame and then having frozen thereon forms an ice sheet, wherein said secondary connectors and said ice sheet completely cover said sheet means at upper and side portions of said frame, wherein said frame members comprise rigid elongated tubular members and wherein said second connectors comprise elongated flexible covering members spreadable for positioning over said sheet means and said tubular members with said sheet means being imprisoned between said tubular members and said covering members, wherein peripheral protective bands are provided for positioning between said secondary connectors and said sheet means for at least one of protecting said sheet means from said secondary connectors and allowing said sheet means to be slidably displaced relative to said frame even when connected thereto by said secondary connectors.

2. A portable ice rink as defined in claim 1, wherein said tubular members and said covering members are each made of plastics material.

3. A portable ice rink as defined in claim 1, wherein said sheet means is dimensioned such to define, when installed to said frame, a peripheral take-up strip outwardly of said frame hereby providing material for allowing said sheet means to be displaced inwardly relative to said frame while retaining said sheet means assembled to said frame by way of said secondary connectors.

4. A portable ice rink as defined in claim 1, wherein primary connectors are provided for connecting the frame members together, said primary connectors comprise resilient connecting rods insertable at ends thereof in facing open ends of adjacent tubular members for interconnecting said tubular members while allowing for relative displacement therebetween upon a need for said frame to expand.

5. A portable ice rink as defined in claim 4, wherein said connecting rods are adapted to be bent for forming corners of said frame.

6. A portable ice rink comprising sheet means, a plurality of frame members adapted to be connected in an end-to-end relationship such as to form a closed fame for said rink, said sheet means being adapted to be laid across said frame and to be connected thereto by way of secondary connectors, said secondary connectors being provided substantially continuously along said frame, whereby water deposited onto said sheet means inwardly of said frame and then having frozen thereon forms an ice sheet, wherein said secondary connectors and said ice sheet completely cover said sheet means at upper and side portions of said frame, wherein peripheral protective bands are provided for positioning between said secondary connectors and said sheet means for at least one of protecting said sheet means from said secondary connectors and allowing said sheet means to be slidably displaced relative to said frame even when connected thereto by said secondary connectors.

* * * * *